US006001527A

United States Patent [19]

Ishihara et al.

[11] Patent Number: 6,001,527

[45] Date of Patent: Dec. 14, 1999

[54] ELECTROSTATIC CHARGE IMAGE DEVELOPER, IMAGE FORMATION METHOD AND IMAGE FORMING DEVICE

[75] Inventors: Yuka Ishihara; Masanori Ichimura; Takashi Imai; Hiroshi Takano; Hiroshi Nakazawa; Yoshifumi Iida; Susumu Yoshino, all of Minami-Ashigara-shi, Japan

[73] Assignee: Fuji Xerox Co., Ltd., Tokyo, Japan

[21] Appl. No.: 08/995,221

[22] Filed: Dec. 19, 1997

[30] Foreign Application Priority Data

Dec. 26, 1996 [JP] Japan ..... 8-347547

[51] Int. Cl.[6] ..... G03G 9/097

[52] U.S. Cl. ..... 430/110; 430/111; 430/120; 399/252

[58] Field of Search ..... 430/110, 111

[56] References Cited

U.S. PATENT DOCUMENTS

| | | | |
|---|---|---|---|
| 2,297,691 | 10/1942 | Carlson | 430/31 |
| 2,357,809 | 9/1944 | Carlson | 430/31 |
| 5,272,040 | 12/1993 | Nakasawa et al. | 430/110 |

FOREIGN PATENT DOCUMENTS

| | | |
|---|---|---|
| 46-5782 | 12/1971 | Japan . |
| 48-47345 | 7/1973 | Japan . |
| 48-47346 | 7/1973 | Japan . |
| 60-136755 | 7/1985 | Japan . |
| 60-186844 | 9/1985 | Japan . |
| 61-80161 | 4/1986 | Japan . |
| 61-80162 | 4/1986 | Japan . |
| 61-80163 | 4/1986 | Japan . |
| 64-13560 | 1/1989 | Japan . |
| 64-73354 | 3/1989 | Japan . |
| 1-118150 | 5/1989 | Japan . |
| 1-237561 | 9/1989 | Japan . |
| 2-79862 | 3/1990 | Japan . |
| 5-72797 | 3/1993 | Japan . |
| 5-204183 | 8/1993 | Japan . |
| 8-6286 | 1/1996 | Japan . |
| 8-269359 | 10/1996 | Japan . |

*Primary Examiner*—Roland Martin
*Attorney, Agent, or Firm*—Oliff & Berridge PLC

[57] ABSTRACT

The present invention provides an electrostatic image developer comprising a toner and a carrier wherein the toner includes toner particles having an average particle diameter of 3 to 9 $\mu$m, a hydrophobic silica microparticles having a BET specific surface area of 40 to 120 $m^2/g$, and a hydrophobic titanium compound microparticles having a BET specific surface area of 40 to 250 $m^2/g$; and wherein the carrier is a resin coated carrier having a coating layer of a resin. The electrostatic image developer can improve the environmental dependency of charging, power fluidity, resistance to caking of a toner and reduced change in charging with time course to provide an image with an excellent image quality for a long period of time.

18 Claims, No Drawings

ELECTROSTATIC CHARGE IMAGE DEVELOPER, IMAGE FORMATION METHOD AND IMAGE FORMING DEVICE

BACKGROUND OF THE INVENTION

1. Field of the Invention

The present invention relates to an electrostatic image developer used for developing an electrostatic image in an electrophotographic method, electrostatic recording method and the like. The present invention also relates to an image formation method and image forming device using the electrostatic developer.

2. Description of the Related Art

In recent, an electrophotographic method for visualizing image information through an electrostatic latent image has been used in various fields. This method is well known as disclosed in U.S. Pat. Nos. 2,297,691 and 2,357,809. The electrophotographic method generally comprises a charging and exposure step of forming an electrostatic latent image on a photosensitive member, a developing step of developing the electrostatic latent image using a developer including a toner to form a toner image, a transfer step of transferring the toner image to a transfer member, e.g., paper and a sheet, a fixing step of fixing the toner image to the transfer member using heat, a solvent, pressure and the like to prepare a permanent image.

Although the toner used in the above electrophotographic method is designed to meet the requirements in the above steps, the toner is suffered from the stress and impact generated due to the contact with a charge donating member or other members in a developing unit to be deteriorated in its structure and properties during copying repeatedly. Therefore, the image is also deteriorated during copying repeatedly. The toner is required to be produced using a tough binder which can withstand a mechanical stress and impact, in order to provide a highly reliable image over a long period of time.

On the other hand, for process adaptability in a copying machine, the toner is required to have excellent fluidity, caking resistance, fixing capability, chargeability, cleaning characteristics and the like. In recent years, it has been proposed that additives with high add value which can provide excellent fluidity, caking resistance, charge maintenance capability, environmental stability, and the like were added to the toner. For example, it has been proposed that inorganic oxides such as silica, titanium oxides, or the like are externally added to the toner.

Silica has excellent caking resistance and ability to impart fluidity, but has the drawback of great environmental dependency of charging due to a core with highly negative chargeability. Therefore, there are various proposes in which the surface of silica is hydrophobically treated (see Japanese Patent Application Laid-Open (JP-A) Nos. 46-5782, 48-47345, 48-47346, 64-73354, and 1-237561). However, no methods including these proposals can sufficiently achieve the improvement in the environmental dependency of charging without adversely affecting the caking resistance, fluidity and the like of silica.

The external addition of titanium oxide to the toner leads to a low charging level of the toner. The titanium oxide in the same kind of core can easily control the charging level and the environmental dependency by using a surface-hydrophobic treating agent, while the titanium oxide has a problem of aggregation and the like after hydrophobic treatment, and limits the amount to be hydrophobically treated. Therefore, the titanium oxide cannot attain the charging level lower than the given level.

Titanium oxide can be generally produced by refining $TiO(OH)_2$ prepared in a sulfuric acid process (a wet process) using ilmenite ore followed by heating to sinter. Such a titanium oxide produced in this manner naturally include aggregated particles produced as a result of the dehydration-condensation.

However, it is not easy to redisperse such aggregated particles in conventional methods. Crystal type titanium oxide (rutile: a specific gravity of 4.2, anatase: a specific gravity of 3.9) obtained as micropowder forms secondary or tertiary aggregation and is inferior to silica in an ability to improve the fluidity characteristics of the toner. Especially, there is a tendency to use a smaller particle diameter, in order to meet the needs of the market for an excellent image. Use of the smaller particle diameter of the toner however leads to the increased adhesive force between particles, and thus the decreased fluidity of the toner and more decreased ability for titanium oxide to impart fluidity.

In order to achieve both of the improved fluidity and environmental dependency of charging, there is a proposal in which hydrophobic titanium oxide processed by surface hydrophobic treatment, in combination with hydrophobic silica is externally added to the toner (see JP-A No. 60-136755 and the like).

However, stress, e.g., stirring tends to induce a defect of either silica or titanium oxide so that it is difficult for the both to compensate the defects each other over a long period of time. For example, hydrophobic titanium oxide can primarily improve the chargeability and fluidity of the toner. A coupling agent is peeled off the surface by the collision between the toner and a carrier or the friction between the toner and a blade or a sleeve in stirring, and thus the charging properties of the toner greatly change. The inventors supposed that in case of hydrophobic titanium oxide, the reactivity of its core surface with the coupling agent is poor and thus the bonding with the coupling agent is much weaker than that of silica. There is also the problem that these external additives are embedded into the surface of the toner, which causes the decreased power fluidity, and which causes contamination of these external additives to the surface of a carrier.

On the other hand, it has been proposed to add externally a hydrophobic amorphous titanium oxide to the toner (see JP-A Nos. 5-204183 and 5-72797).

This method, however, has the problem that the adhesion of the amorphous titanium oxide with a photosensitive material is strong, which causes damages to the photosensitive material at the time of cleaning and the occurrence of white spots on images.

To the developer was added carrier particles generally called "carrier" as well as the toner. When the carrier is contained in the developer, a charge is generated by the friction between the toner and the carrier to provide the toner with an appropriate amount of positive and negative charge. The carrier is roughly classified into a coated type carrier having a surface coating layer and a non-coated type having no surface coating layer. Since the coated carrier is superior in terms of the life of the developer, various coated carrier have been developed and put to the practical use.

The coated carrier is required at least to provide the toner with adequate chargeability (charge amount and charge distribution) and to maintain the adequate chargeability over a long period of time.

Various coated carriers, which do not change the chargeability of the toner, have excellent impact resistance, frictional resistance and the like, and are stable to environmental changes, e.g., temperature and humidity, are proposed.

For example, JP-A Nos. 61-80161, 61-80162, and 61-80163 disclose that a copolymer of nitrogen-containing fluorinated alkyl(meth)acrylate and a vinyl-type monomer, or a copolymer of fluorinated alkyl(meth)acrylate and a nitrogen-containing monomer is applied to the surface of a carrier core to obtain a relatively long-lived coated carrier. Furthermore, there are disclosed that a polyamide resin (JP-A No. 1-118150) or a melamine resin (JP-A No. 2-79862) is applied to the surface of a carrier core and cured to obtain a coated carrier having a relatively hard coating.

These carriers, however, have the problems that the contamination of the toner to the carrier surface, i.e., the impaction cannot be perfectly prevented.

In order to prevent the impaction, for example, a silicone resin as described in JP-A No. 60-186844 or a fluorine-type resin as described in JP-A No. 64-13560 may be used to form a coating layer for the carrier.

However, in such a carrier, the silicone resin or the fluorine-type resin exists in a considerably large amount in the vicinity of the surface but in a little amount in the center. When such a carrier is used for a long period of time, a coating layer of the carrier is worn thereby gradually losing the effects of the silicone resin or the fluorine-type resin, while the impaction gradually occurs.

Therefore, the effects of each independent development of the external additives and the carrier are still insufficient to improve the developer.

A method in which toners are developed and transferred every color, specifically, developing and transfer steps are plurally repeated to form at least three toner layers on a same support member, e.g., paper, is used for full-color copying machines which attract considerable attention. However, the original image density is larger and the area coating between the toner and the photosensitive material is larger, as compared with the black-and-white development. The toner is therefore required to have excellent transfer characteristics. In addition, it is necessary that the color toner image fixed to an OHP film has excellent transparency. Since the transparency decreases with increase of the external additive, the toner may possess the function to prevent the significantly reduced transparency even in added external additives.

SUMMARY OF THE INVENTION

It is an object of the present invention to solve the problems in the conventional technologies and to attain the following objects:

Specifically, an object of the present invention is to provide an electrostatic image developer which has improved environmental dependency of charging, powder fluidity and caking resistance. Another object of the present invention is to provide an electrostatic image developer which can exhibit a smaller difference in chargeability with time and can maintain an excellent image quality over a long period of time. A further object of the present invention is to provide an electrostatic image developer which provides an image with high quality by eliminating image defects due to the contamination of external additives to a photosensitive material and the fogging on the background due to the embedding of external additives. A still further object of the present invention is to provide an image formation method and an image forming device using these excellent electrostatic image developer to form the image with high quality.

The above problems will be solved by the following;

(i) an electrostatic image developer comprising a toner and a carrier, wherein the toner includes toner particles having an average particle diameter of 3 to 9 $\mu$m; a hydrophobic silica microparticles having a BET specific surface area of 40 to 120 $m^2/g$; and a hydrophobic titanium compound microparticles having a BET specific surface area of 40 to 250 $m^2/g$, and wherein the carrier is a resin coated carrier having a coating of a resin, (ii) An electrostatic image developer according to (i), wherein a weight ratio (b/a) of the amount of the hydrophobic titanium compound microparticles (b % by weight) to the amount of the hydrophobic silica microparticles (a % by weight) is less than 1, that is (b/a)<1, (iii) An electrostatic image developer according to (i) or (ii), wherein the amount of the hydrophobic silica microparticles is less than 2% by weight based on the amount of the toner and the amount of the hydrophobic titanium compound microparticles is less than 1.5% by weight based on the amount of the toner, (iv) An electrostatic image developer according to any one of (i) to (iii), in which the hydrophobic titanium compound microparticles are prepared by reacting $TiO(OH)_2$ with a silane compound, (v) An electrostatic image developer according to any one of (i) to (iv), in which the specific gravity of the hydrophobic titanium compound microparticles is from 2.8 to 3.6, (vi) An electrostatic image developer according to any one of (i) to (v), in which the toner particles contain a linear polyester as a binding resin, (vii) An electrostatic image developer according to any one of (i) to (vi), in which the resin contains at least a fluorine-type resin and/or a silicone resin, (viii) An electrostatic image developer according to any one of (i) to (vii), in which the coating is comprised of the resin and resin particles dispersed in the resin, (ix) An electrostatic image developer according to (viii), in which the particle diameter of the resin particles is from 0.1 to 2 $\mu$m, (x) An electrostatic image developer according to (viii) or (ix), in which the resin particles are made of a nitrogen-containing resin, (xi) An electrostatic image developer according to any one of (viii) to (x), in which the resin particles are made of a cross-linking resin, (xii) An electrostatic image developer according to any one of (i) to (xi), in which the coating comprises electroconductive particles dispersed in the resin, (xiii) An electrostatic image developer according to (xii), in which the electroconductive particles are comprised of carbon black, (xiv) An image forming method comprising a step of developing an electrostatic latent image formed on an electrostatic latent image support member using a developer layer on a developer holding member carrying the developer in which the developer is the electrostatic image developer according to any one of (i) to (xiii), and (xv) An image forming device comprising a means of developing an electrostatic latent image formed on an electrostatic latent image support member using a developer layer on a developer holding member carrying the developer in which the developer is the electrostatic image developer according to any one of (i) to (xiii).

DESCRIPTION OF THE PREFERRED EMBODIMENTS

The electrostatic image developer, image formation method, and image forming device of the present invention will be described in detail.

The electrostatic image developer of the present invention comprises a toner and a carrier which will be described in the following:

(Toner)

The toner contains at least toner particles, hydrophobic silica microparticles and hydrophobic titanium compound microparticles. In other words, at least the hydrophobic silica microparticles and the hydrophobic titanium compound microparticles are externally added to the toner particles to form the toner.

Hydrophobic Silica Microparticles

The hydrophobic silica microparticles have a BET specific surface area of 40 to 120 $m^2/g$, preferably 40 to 80 $m^2/g$.

If the BET specific surface area of the hydrophobic silica microparticles is less than 40 $m^2/g$, not only filming and damages to the surface of a photosensitive material are induced but also the transparency of an OHP image probably decreases. On the other hand, if the BET specific surface area of the hydrophobic silica microparticles is larger than 120 $m^2/g$, it exhibits only an effect of improved powder fluidity of the toner, while it has difficulty to control the adhering condition to the toner and exhibits no improved effect on the transfer characteristics.

The amount of the hydrophobic silica microparticles added to the toner is preferably less than 2% by weight and more preferably less than 1.5% by weight.

If the amount of the hydrophobic silica microparticles in the toner exceeds 2% by weight, not only the environmental dependency of charging is impaired but also it may promote the wear of a photosensitive material.

The hydrophobic silica microparticles can be produced, for example, by processing adequately prepared or commercially available silica with hydrophobic treatment.

The hydrophobic treatment can be performed, for example, by dipping silica in a hydrophobic treating agent. Examples of the hydrophobic treating agent may include, but are not limited to, silane coupling agents, silicone oil, titanate coupling agents, aluminum coupling agents and the like. These agents may be either singly or in combinations of two or more. Among these agents, silane coupling agents are preferred.

The silane coupling agents may include any types of silane compounds, for example, chlorosilane, alkoxysilane, silazane, and specialty silylating agent. Specific examples of the silane coupling agents may include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

The amount of the hydrophobic treating agent depends on the type of silica and cannot be determined in general. It usually ranges from 2 to 50 parts by weight, preferably 5 to 20 parts by weight based on 100 parts by weight of silica.

In the present invention, commercially available products can be preferably used as the hydrophobic silica microparticles.

Hydrophobic Titanium Compound Microparticles

The hydrophobic titanium compound microparticles have a BET specific surface area of 40 to 250 $m^2/g$, preferably 70 to 180 $m^2/g$.

If the BET specific surface area of the hydrophobic titanium compound microparticles is less than 40 $m^2/g$, not only filming and damages to the surface of a photosensitive material are induced but also the transparency of an OHP image probably decreases. On the other hand, if the BET specific surface area of the hydrophobic titanium compound microparticles is larger than 250 $m^2/g$, it exhibits only an effect of improved powder fluidity of the toner, while it has difficulty in controlling the adhering condition to the toner and exhibits no improved effect on the transfer characteristics.

The amount of the hydrophobic titanium compound microparticles added to the toner is preferably not more than 1.5% by weight, more preferably not more than 1.2% by weight.

If the amount of the hydrophobic titanium compound microparticles added to the toner exceeds 1.5% by weight, the OHP transparency of a color toner significantly decreases with no change in the chargeability.

The above-mentioned $TiO(OH)_2$ can be produced using a sulfuric acid process (a wet process) using an ilmenite ore according to the following chemical formula:

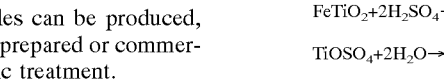

$$FeTiO_2+2H_2SO_4 \rightarrow FeSO_4+TiOSO_4+2H_2O$$

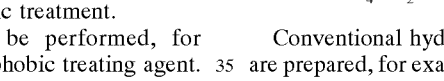

$$TiOSO_4+2H_2O \rightarrow TiO(OH)_2+H_2SO_4$$

Conventional hydrophobic titanium oxide microparticles are prepared, for example, by sintering $TiO(OH)_2$. However, the hydrophobic titanium compound microparticles of the present invention obtained by reacting $TiO(OH)_2$ with a silane compound is preferable, since it has a specific gravity smaller than that of the conventional crystal titanium oxide.

If reacting $TiO(OH)_2$ with a silane compound in a solvent, the silane compound can be reacted during hydrolysis of $TiO(OH)_2$. Consequently, surface of the titanium compound produced from $TiO(OH)_2$ is treated with the silane compound as it is in a state of primary particle to obtain hydrophobic titanium compound microparticles in a primary particle state without aggregation. Therefore, the present invention, advantageously provides a color image which has excellent fluidity, caking resistance and transparency required for a color toner.

The hydrophobic titanium compound microparticles can be obtained, specifically, by adding the silane compound to $TiO(OH)_2$, preferably an agueous dispersion containing $TiO(OH)_2$; and hydrophobically treating of a part or all OH groups of $TiO(OH)_2$, followed by filtering, washing, drying and pulverizing the reaction product.

Examples of the silane compounds may include, but not be limited to, the aforementioned silane compounds, especially silane coupling agents, silicone oil, titanate coupling agents, and aluminum coupling agents. Among these, silane coupling agents are preferable. The amount of the silane compound is preferably from 2 to 50 parts by weight and more preferably from 5 to 20 parts by weight based on 100 parts by weight of $TiO(OH)_2$.

In this reaction, selection of the type and amount of the silane compound may control the specific gravity, negative chargeability and the like of the hydrophobic titanium compound microparticles in detail. The larger amount of the silane compound may provide hydrophobic titanium compound microparticles having a smaller specific gravity and higher ability to impact charge, while the smaller amount of the silane compound may provide hydrophobic titanium compound microparticles having a larger specific gravity and lower ability to impact charge.

The specific gravity of the hydrophobic titanium compound microparticles is preferably from 2.8 to 3.6, more preferably from 3.0 to 3.5. If the specific gravity of the hydrophobic titanium compound is in the above defined range, the amount can be smaller than required to obtain the same effect in terms of the improved environmental dependency of charging and the improved fluidity because of the lower specific gravity than that of the conventional titanium compound. Also, the above defined range of the hydrophobic titanium compoud may provide other various excellent properties without impairing the tranparency of a color toner.

On the other hand, if the specific gravity of the hydrophobic titanium compound microparticles is less than 2.8, it is required to add an excess amount of the silane compound. Therefore, a part of silane compounds reacts each other to form an aggregation with undesired fluidity. If the specific gravity of the hydrophobic titanium compound microparticles is larger than 3.6, the hydrophobic titanium compound microparticles can hardly disperse to the surface of the toner at the time of bleeding. Also, even if these can disperse uniformly, the hydrophobic titanium compound microparticles adheres to the convex portions of the toner. These adhered microparticles to the convex portions are transferred to the concave portions of the toner by the stress in the developing step, which causes the reduced fluidity and chargeability. Alternatively, these adhered microparticles to the convex portions tend to get free. In a two-component developer, the free hydrophobic titanium compound microparticles move to the surface of the carrier to change the volume specific resistivity. Therefore, it is impossible to provide an image with excellent quality for a long period of time.

In the present invention, preferably weight ratio (b/a) is less than 1, i.e., $b/a<1$, wherein a % by weight means the amount of the hydrophobic silica compound microparticles; and b % by weight means the amount of the hydrophobic titanium compound microparticles in the toner.

If the weight ratio (b/a) of the amount of the hydrophobic titanium microparticles to the amount of the hydrophobic silica is greater than 1, any one of the chargeability, stability with time, transfer characteristics, and cleaning characteristics is impaired so that all properties are compatible with difficulty, whereas a weight ratio (b/a) less than 1 may advantageously improve the environmental dependency of charging and the stability with time without adversely affecting the fluidity of the toner and secondary drawbacks, for example, contamination to the photosensitive material and poor cleaning, thereby providing an image with excellent quality.

The toner in the present invention may include other external additives as well as the hydrophobic silica microparticles and the hydrophobic titanium compound microparticles. In other word, the other external additives may be added to the toner.

Examples of the other external additives may be charge control agents, offset preventives, magnetic materials, and cleaning adjuvants and/or transfer adjuvants and the like.

Examples of the charge control agents may include, but not limited to, azo type metal complexes, metal complexes of salicylic acid or alkylsalicylic acid and the like as well as well known compounds.

Examples of the offset preventives may include those made of low molecular weight propylene, low molecular weight polyethylene, wax and the like.

The magnetic materials may be, but not be limited to, known magnetic materials. The magnetic material is formulated in the toner to produce a magnetic toner whereas no magnetic material is formulated to produce a non-magnetic toner.

Examples of cleaning adjuvants and/or transfer adjuvants may include polystyrene microparticles, polymethylmethacrylate microparticles, and polyvinylidene fluoride microparticles.

In the present invention, the hydrophobic silica microparticles, the hydrophobic titanium compound microparticles, and the other external additives are added to the toner particles and mixed. Examples of an apparatus used for mixing these compounds may be, but not be limited to, a V-blender, Henshel mixer and the like.

The resulting mixture of hydrophobic silica microparticles, hydrophobic titanium compound microparticles and the other external additives may either physically adhere to, or be loosely secured to the toner particles. Also, the surface of the toner particles may be coated either entirely or partly. In addition, it is preferable to apply the hydrophobic silica microparticles in a form of a single layer.

The toner particles may include a binding resin and colorants as major components.

Examples of the binding resin may include, but not be limited to, homopolymers or copolymers including styrenes such as styrene, chlorostyrene and the like; mono-olefins such as ethylene, propylene, butylene, isoprene and the like; vinyl esters such as vinyl acetate, vinyl propionate, vinyl benzoate, vinyl lactate and the like; α-methylene aliphatic mono-carboxylates such as methylacrylate, ethylacrylate, butylacrylate, dodecylacrylate, octylacrylate, phenylacrylate, methylmethacrylate, ethylmethacrylate, butylmethacrylate, dodecylmethacrylate and the like; vinyl ethers such as vinyl methyl ether, vinyl ethyl ether, vinyl butyl ether and the like; and vinyl ketones such as vinyl methyl ketone, vinyl hexyl ketone, vinyl isopropenyl ketone and the like. Among these, typical binding resins may be, for example, polystyrene, styrene-alkylacrylate copolymers, styrene-butadiene copolymers, styrene-maleic acid anhydride copolymers, polyethylene, polypropylene and the like. Further, polyester, polyurethane, epoxy resins, silicon resins, polyamide, modified rosin, paraffin wax and the like may be used.

Examples of the colorants may include, but are not limited to, carbon black, Aniline Blue, Chalcoil Blue, chrome yellow, ultramarine blue, Du Pont Oil Red, Quinoline yellow, Methylene Blue chloride, Phthalocyanine Blue, Malachite Green Oxalate, lamp black, Rose Bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, and Pigment Blue 15:3 and the like.

In the present invention, size, shape, structure and the like of the toner particles may not be limited, but may be optionally selected according to the object. Those optionally prepared and commercially available products may be used.

(Carrier)

The carrier may be comprised of a carrier core coated with a coating layer of a resin.

The carrier core may not be limited, but may be optional selected according to the object. Examples of the carrier core may include metal powder of iron, steel, nickel, cobalt and the like; magnetic oxide powder such as ferrite, magnetite and the like; glass beads; metal powder and the like. Among these, materials having magnetic properties are preferable in case of using a magnetic blushing method.

The average particle diameter of the carrier core material is generally from 10 to 500 μm, preferably from 30 to 100 μm.

The resin may not be limited, but may be optionally selected according to the object, as long as the resin can use as a matrix resin. Examples of the resin may be known resins including polyolefin type resins such as polyethylene, polypropylene and the like; polyvinyl type resins or polyvinylidene type resins such as polystyrene, acryl resins, polyacrylonitrile, polyvinyl acetate, polyvinyl alcohol, polyvinyl butyral, polyvinyl chloride, polyvinyl carbazole, polyvinyl ether, polyvinyl ketone and the like; vinyl chloride-vinyl acetate copolymers; styrene-acrylic acid copolymer; straight silicon resins containing an organosiloxane bond or modifications thereof; fluorine type resins such as polytetrafluoroethylene, polyvinyl fluoride, polyvinylidene fluoride, polychlorotrifluoroethylene and the like; silicone resins; polyester; polyurethane; polycarbonate; phenol resins; amino resins such as urea-formaldehyde resins, melamine resins, benzoguanamine resins, urea resins, polyamide resins and the like; epoxy resins, and the like.

These resins may be used either singly or in combinations of two or more. In the present invention, it is desirable to use at least a fluorine-based resin and/or a silicone resin among these resins. Advantageously, use of at least a fluorine-based resin and/or a silicone resin as the resin exhibits an excellent effect without the carrier contamination (impaction) by the toner or the external additives.

The coating layer of the resin comprises at least resin particles and/or electroconductive particles dispersed in the resin.

Examples of the resin particles may include thermoplastic resin particles and thermosetting resin particles. Among these, thermosetting resins are preferable, since it may easily provide the increased hardness. Also, resin particles made of a nitrogen-containing resin which contains a nitrogen (N) atom are preferable, since it may provide the toner with a negative chargeability. In addition, in the present invention, resin particles made of a cross-linking resin are preferable in terms of the wear resistance and the durability upon using repeatedly. These resins may be used either singly or in combinations of two or more.

The average particle diameter of the resin particles is, for example, preferably from 0.1 to 2 μm, more preferably from 0.2 to 1 μm. If the average particle diameter of the resin particles is less than 0.1 μm, the dispersibility of the resin particles in the coating layer is impaired. On the other hand, if the average particle diameter exceeds 2 μm, the resin particles tends to get free from the coating layer and thus cannot function as expected.

The resin particles may be prepared optionally, or commercially available.

A method for manufacturing the resin particles may be, but not limited to, optionally selected according to the object from methods in which a monomer or an oligomer is dispersed in a poor solvent to carry out a cross-linking reaction such as suspension polymerization, emulsion polymerization and thereby to granulate by the aid of the surface tension; methods in which a low molecular component and a cross-linking agent are mixed and reacted by means of molten-kneading or the like and then the resulting product is pulverized to a prescribed grain size by wind or mechanical force; and the like.

Examples of the electroconductive particles may include metal particles such as gold, silver, copper and the like; semiconductive oxide particles such as carbon black particles, titanium oxide, zinc oxide and the like; and particles produced by coating the surface of powder of titanium oxide, zinc oxide, barium sulfate, aluminum borate, potassium titanate and the like with tin oxide, carbon black, a metal and the like.

These materials may be used either singly or in combinations of two or more. Among these, carbon black particles are preferable in terms of high manufacturing stability, low cost, excellent electroconductivity and the like. Carbon black having a DBP oil absorption of 50 to 250 ml/100 g is preferable because of high manufacturing stability, although there are no limitations to the type of carbon black.

Examples of a method for manufacturing the coating layer may include, but are not limited to, methods using a film forming liquid which contains in a solvent, the resin particles such as cross-linking resin particles and/or the electroconductive particles, and the resin used as a matrix resin such as a styrene acryl resin, fluorine-based resin, silicone resin and the like.

Specifically, the coating layer can be formed by a dipping method which comprises a step of dipping the carrier core material in the film forming liquid; a spraying method which comprises a step of spraying the film forming liquid on the surface of the carrier core material; a fluidized bed method which comprises a step of spraying the film forming liquid while the carrier core material is floated by air-flow; a kneader-coater method in which the carrier core material and the film forming liquid are mixed, followed by distilling a solvent and the like. Among these methods, a kneader-coater method is preferable in the present invention.

The solvent used for producing the film forming liquid may be, but is not limited to, optionally selected from known solvents, as long as it could dissolve only the resin used as the matrix resin. Examples of the solvent may include aromatic solvents such as toluene, xylene and the like, ketones such as acetone, methyl ethyl ketone and the like, and ethers such as tetrahydrofuran, dioxane and the like.

The average thickness of the coating layer produced in this manner is usually from 0.1 to 10 μm, preferably from 0.2 to 3 μm.

When the resin particles are dispersed in the coating layer, the resin particles and the resin used as the matrix resin are uniformly dispersed in the direction of the thickness and along the direction of the carrier surface. Therefore, the carrier can maintain the same surface composition as that of a new, unused carrier, even if the carrier is used for a long period of time and the coating layer is worn. Therefore, excellent ability to impart charge to the toner can be maintained for a long period of time. When the electroconductive particles are dispersed in the coating layer, the electroconductive particles and the resin used as the matrix resin are uniformly dispersed in the direction of the thickness and along the direction of the carrier surface. The carrier can also maintain the same surface composition as that of a new, unused carrier, even if the carrier is used for a long period of time and the coating is worn. Therefore, it can prevent the deterioration in solid image reproduction for a long period of time. In addition, in case where the resin particles and the electroconductive particles are both dispersed in the coating layer, each effect mentioned above can be produced simultaneously.

Any method for blending each component may be used to obtain the electrostatic image developer of the present invention as long as the above mentioned components are included. For example, the electrostatic image developer may be produced by blending the carrier with the toner which is produced by adding externally the hydrophobic silica microparticles and the hydrophobic titanium compound microparticles to the toner particles. Alternatively, the electrostatic image developer may be produced by blending the hydrophobic silica microparticles, the hydrophobic titanium compound microparticles, the toner particles and the carrier at the same time.

The image formation method of the present invention is characterized in that the electrostatic image developer of the present invention is used as a developer in a known image formation method comprising a step of developing an electrostatic latent image formed on an electrostatic latent image support member using a developer layer on a developer holding member carrying the developer. Furthermore, the image forming device of the present invention is characterized in that the electrostatic image developer of the present invention is used as a developer in a known image forming device comprising a means of developing an electrostatic latent image formed on an electrostatic latent image support member using a developer layer on a developer holding member carrying the developer.

In the image formation method and the image forming device, charging step, image exposure step, developing step, transfer step, fixing step and the like are carried out.

The charging step comprises applying optionally selected voltage to the surface of the image support member to charge the surface. For example, a known contact or non-contact charger equipped with electroconductive or semi-conductive roll, brush, film, rubber blade and the like is appropriately selected to carry out this charging.

The material, shape, structure, size and the like of the image support member may not be limited, but be optionally selected according to the object. Preferable examples of the image support member may include a known electrophotographic sensitive material and an electrostatic latent image support material.

The image exposure step comprises exposing the charged surface of the image support member to light to form an image corresponding to the image to be formed, thereby forming an electrostatic latent image. This operation can be performed using a known exposure utilizing a known light source, for example, LED light, liquid crystal shutter light and semiconductor laser light.

The developing step comprises developing the above electrostatic latent image using a developer to form a toner image. It may be performed using a known developing device.

The transfer step comprises transferring the toner image on a transfer material, e.g., paper. It can be carried out by a known transfer charger through non-contact transfer utilizing corona discharge, or contact transfer utilizing a transfer belt, transfer roller and the like.

The fixing step comprises fixing the toner image transferred to the transfer material. It can be performed using a known fixing device such as a heat roller fixing device.

The image formation method of the present invention can be effected appropriately using each means including the aforementioned charger, image exposure, developing device, transfer charger and fixing device. More the image forming device of the present invention can be adequately provided with each means including the aforementioned charger, image exposure, developing device, transfer charger and fixing device.

EXAMPLES

The present invention will be illustrated in more detail by the following examples, which are not construed to limit the scope of the present invention. In the following illustration, the "part(s)" means "part(s) by weight", unless otherwise noted.

First, ilmenite was used as an ore and dissolved in sulfuric acid to separate iron powder. The resulting solution was subjected to a wet sedimentation process in which $TiOSO_4$ was hydrolyzed to produce $TiO(OH)_2$. In this step for producing $TiO(OH)_2$, the dispersion was controlled for the creation of a core and the hydrolysis and washed.

Preparation of Hydrophobic Titanium Compound Microparticles A (The Compound According to the Present Invention)

100 parts of $TiO(OH)_2$ which had been prepared above was dispersed in 1000 ml of water, to which was added dropwise 20 parts of isobutyltrimethoxysilane at room temperature with stirring. The resulting product was subjected to filtration and washed, and these steps were repeated to produce a titanium compound which surface was hydrophobically treated with isobutyltrimethoxysilane. The titanium compound was dried at 150° C. to prepare a hydrophobic titanium compound microparticles A (the compound according to the present invention) having a BET specific surface area of 120 $m^2/g$ and a specific gravity of 3.4.

Preparation of Hydrophobic Titanium Compound Microparticles B (The Compound According to the Present Invention)

The same procedures as in the preparation of the hydrophobic titanium compound microparticles A were carried out, except that the amount of isobutyltrimethoxysilane was changed to 10 parts, to prepare a hydrophobic titanium compound microparticles B (the compound according to the present invention) having a BET specific surface area of 100 $m^2/g$ and a specific gravity of 3.5.

Preparation of Hydrophobic Titanium Compound Microparticles C (The Compound According to the Present Invention)

The same procedures as in the preparation of the hydrophobic titanium compound microparticles A were carried out, except that the amount of isobutyltrimethoxysilane was changed to 30 parts, to prepare a hydrophobic titanium compound microparticles C (the compound according to the present invention) having a BET specific surface area of 180 $m^2/g$ and a specific gravity of 3.2.

Preparation of Hydrophobic Titanium Compound Microparticles D (The Compound According to the Present Invention)

100 parts of $TiO(OH)_2$ which had been prepared above was dispersed in 1000 ml of water, to which was added dropwise 25 parts of methyltrimethoxysilane at room temperature with stirring. The resulting product was subjected to filtration and washed, and these steps were repeated to produce a titanium compound which surface was hydrophobically treated with methyltrimethoxysilane. The titanium compound was dried at 180° C. to prepare a hydrophobic titanium compound microparticles D (the compound according to the present invention) having a BET specific surface area of 250 $m^2/g$ and a specific gravity of 3.3.

Preparation of Hydrophobic Titanium Compound Microparticles E (The Compound According to the Present Invention)

The same procedures as in the preparation of the hydrophobic titanium compound microparticles D were carried out, except that the amount of methyltrimethoxysilane was changed to 10 parts, to prepare a hydrophobic titanium compound microparticles E (the compound according to the present invention) having a BET specific surface area of 40 $m^2/g$ and a specific gravity of 3.1.

Preparation of Hydrophobic Titanium Compound Microparticles F (The Compound According to the Present Invention)

The same procedures as in the preparation of the hydrophobic titanium compound microparticles D were carried out, except that the amount of methyltrimethoxysilane was changed to 30 parts, to prepare a hydrophobic titanium compound microparticles F (the compound according to the present invention) having a BET specific surface area of 90 $m^2/g$ and a specific gravity of 2.8.

Preparation of Hydrophobic Titanium Compound Microparticles G (A Comparative Example)

The same procedures as in the preparation of the hydrophobic titanium compound microparticles D were carried out, except that the amount of methyltrimethoxysilane was changed to 5 parts, to prepare a hydrophobic titanium compound microparticles G (a comparative example) having a BET specific surface area of 20 $m^2/g$ and a specific gravity of 3.6.

Preparation of Hydrophobic Titanium Compound Microparticles H (The Compound According to the Present Invention)

100 parts of $TiO(OH)_2$ prepared above was heated at 700° C. and then pulverized in a wet condition. To the pulverized $TiO(OH)_2$ was added dropwise 30 parts of isobutyltrimethoxysilane and the mixture was heated at 200° C. The wet resulting product (in the form of slurry) was filtered, washed, and dried. The dried product was pulverized in a dry condition to prepare a hydrophobic titanium compound microparticles H (the compound according to the present invention) having a BET specific surface area of 110 $m^2/g$ and a specific gravity of 4.2.

Preparation of Hydrophobic Titanium Compound Microparticles I (The Compound According to the Present Invention)

100 parts of $TiO(OH)_2$ prepared above was heated at 700° C. and then pulverized in a wet condition. To the pulverized $TiO(OH)_2$ was added dropwise 20 parts of methyltrimethoxysilane and the mixture was heated at 170° C. The wet resulting product (in the form of slurry) was filtered, washed, and dried. The dried product was pulverized in a dry condition to prepare a hydrophobic titanium compound microparticles I (the compound according to the present invention) having a BET specific surface area of 100 $m^2/g$ and a specific gravity of 3.8.

Preparation of Hydrophobic Titanium Compound Microparticles J (A Comparative Compound)

15 parts of methyltrimethoxysilane was added dropwise to 100 parts of $TiO(OH)_2$ prepared above and the mixture was heated at 120° C. The wet resulting product (in the form of slurry) was filtered, washed, and dried. The dried product was pulverized in a dry condition to prepare a hydrophobic titanium compound microparticles J (a comparative compound) having a BET specific surface area of 280 $m^2/g$ and a specific gravity of 3.5.

Production of Carrier A (The Compound According to the Present Invention)

| | |
|---|---|
| Ferrite particles (average particle diameter: 50 μm) | 100 parts |
| Toluene | 14 parts |
| Styrene/methylmethacrylate copolymer (copolymerization ratio: 20:80, molecular weight of 50,000) | 1.5 parts |
| Carbon black (R330R, manufactured by Cabot, DBP oil absorption amount: 70 ml/100 g) | 0.15 parts |
| Phenol resin particles (average particle diameter: 0.5 μm, insoluble in toluene) | 0.3 parts |

A mixture of the above components excluding the ferrite particles was dispersed by a stirrer for 10 minutes to prepare a solution for a coating layer. The solution for layer and the ferrite particles were placed in a vacuum de-gassing type kneader and stirred at 60° C. for 30 minutes. Then, toluene was distilled under reduced pressure to form a coating layer on the ferrite particles, thereby to obtain a carrier.

In the styrene/methacrylate opolmer used as a matrix resin of the coating layer, the carbon black particles and the phenol resin particles were diluted in toluene and dispersed using a sandmil. Therefore, the carbon black particles and the phenol resin particles were uniformly dispersed in the coating layer of the carrier.

Production of Carrier B (The Compound According to the Present Invention)

| | |
|---|---|
| Ferrite particles (average particle diameter: 50 μm) | 100 parts |
| Toluene | 14 parts |
| Styrene/methylmethacrylate copolymer (copolymerization ratio: 20:80, molecular weight of 50,000) | 1.0 parts |
| Perfluorooctylethylacrylate/methylmethacrylate copolymer (copolymerization ratio: 40:60, molecular weight of 50,000) | 0.8 parts |
| Electroconductive particles (Pastrun-type IV (a compound produced by coating barium sulfate particles with tin oxide, manufactured by Mitsui Mining and Smelting Co., Ltd.) | 0.4 parts |
| Cross-linking nylon resin particles (average particle diameter: 0.3 μm, insoluble in toluene) | 0.2 parts |

The above components excluding the ferrite particles were dispersed with a homomixer for 10 minutes to prepare a solution for forming coating layer. The solution for forming coating layer and the ferrite particles were placed in a vacuum de-gassing type kneader and stirred at 60° C. for 30 minutes. Then, toluene was distilled under reduced pressure to form a coating layer on the ferrite particles, thereby to obtain a carrier.

In the styrene/methacrylate copolymer and perfluoroacrylate copolymer used as a matrix resin of the coating layer, the electroconductive particles and the cross-linking nylon resin particles were diluted in toluene and dispersed using a sandmil. Therefore, the electroconductive particles and the cross-linking nylon resin particles were uniformly dispersed in the coating layer of the carrier.

Production of Carrier C (The Compound According to the Present Invention)

| | |
|---|---|
| Ferrite particles (average particle diameter: 45 μm) | 100 parts |
| Toluene | 14 parts |
| Perfluorooctylethylacrylate/methylmethacrylate copolymer (copolymerization ratio: 40:60, molecular weight of 50,000) | 1.7 parts |
| Electroconductive particles (S-1 ($SnO_2$), manufactured by Mitsubishi Materials Corporation) | 0.6 parts |
| Cross-linking methylmethacrylate resin particles (average particle diameter: 0.3 μm, insoluble in toluene) | 0.3 parts |

The above components excluding the ferrite particles were dispersed with a stirrer for 10 minutes to prepare a solution for forming coating layer. The solution for forming coating layer and the ferrite particles were placed in a vacuum de-gassing type kneader and stirred at 60° C. for 30 minutes. Then, toluene was distilled under reduced pressure to form a coating layer on the ferrite particles, thereby to obtain a carrier.

The electroconductive particles and the cross-linking methylmethacrylate resin particles were diluted in toluene and dispersed using a sandmil in the styrene/methacrylate copolymer and perfluoroacrylate copolymer used as a matrix resin of the coating layer. Therefore, the electroconductive particles and the cross-linking methylmethacrylate resin particles were uniformly dispersed in the coating layer of the carrier.

Production of Carrier D (The Compound According to the Present Invention)

| | |
|---|---|
| Ferrite particles (average particle diameter: 45 μm) | 100 parts |
| Toluene | 14 parts |
| Perfluorooctylethylacrylate/methylmethacrylate copolymer (copolymerization ratio: 40:60, molecular weight of 50,000) | 1.6 parts |
| Carbon black (VXC-72, manufactured by Cabot, DBP oil absorption amount: 178 ml/100 g) | 0.12 parts |
| Cross-linking melamine resin particles (average particle diameter: 0.3 μm, insoluble in toluene) | 0.3 parts |

The above components excluding the ferrite particles were dispersed with a stirrer for 10 minutes to prepare a solution for forming coating layer. The solution for forming coating layer and the ferrite particles were placed in a vacuum de-gassing type kneader and stirred at 60° C. for 30 minutes. Then, toluene was distilled under reduced pressure to form a coating layer on the ferrite particles, thereby to obtain a carrier.

In the styrene/methacrylate copolymer and perfluoroacrylate copolymer used as a matrix resin of the coating layer, the carbon black particles and the cross-linking methylmethacrylate resin particles were diluted in toluene and dispersed using a sandmil. Therefore, the carbon black particles and the cross-linking methylmethacrylate resin particles were uniformly dispersed in the coating layer of the carrier.

Production of Toner Particles A

| | |
|---|---|
| Polyester resin (linear polyester prepared from terephthalic acid/bisphenol A-ethylene oxide adduct/cyclohexane dimethanol, Tg: 62° C., Mn: 4,000, Mw: 35,000, acid value: 12, hydroxyl value: 25) | 100 parts |
| Pigment Blue 15:3 | 4 parts |

The above components were molten-kneaded in Banbury mixer and pulverized using a jet mil after cooling. The pulverized product was classified using a pneumatic classifier to prepare toner particles A (cyan toner) having an average particle diameter of 6.5 μm.

Examples 1 to 4

100 parts of the toner particles A, 0.6 parts of the above hydrophobic titanium compound microparticles B (present invention), and 0.8 parts of hydrophobic silica microparticles (BET specific surface area of 50 $m^2/g$) were mixed using a Henschel mixer to prepare a toner.

6 parts of the prepared toner and 100 parts of each of the above carrier A to D were combined and mixed to prepare four electrostatic image developers. An electrostatic image developer containing the carrier A was Example 1, an electrostatic image developer containing the carrier B was Example 2, an electrostatic image developer containing the carrier C was Example 3, and an electrostatic image developer containing the carrier D was Example 4.

These electrostatic image developers were subjected to copying tests using an electrophotographic copying machine (A-Color 630, manufactured by Fuji Xerox Co., Ltd.). The results are shown in Table 1. The copying tests were carried out under an environment of medium temperature and medium humidity (22° C., 55%RH) to measure the charge amount and generation of fogging on the background for a copy sheet at initial stage and after carriages of 30,000 and 100,000 sheets of paper. In the electrostatic image developers prepared in Examples 1 to 4, there are overall no variations in image density and no fogging on the background, exhibiting a stable image.

TABLE 1

| | | | Image at initial stage | Initial stage | | After carriage of 3,000 sheets of paper | | After carriage of 10,000 sheets of paper | |
|---|---|---|---|---|---|---|---|---|---|
| | Toner | Carrier | (under an environment of medium temperature and medium humidity) | Charge amount (μC/g) | Fogging on the background | Charge amount (μC/g) | Fogging on the background | Charge amount (μC/g) | Fogging on the background |
| Example 1 | A | A | No edge effect, good | −22.1 | ○ | −20.1 | ○ | −18.6 | Δ |
| Example 2 | A | B | No edge effect, good | −23.5 | ○ | −22.5 | ○ | −20.8 | ○ |

TABLE 1-continued

| | Toner | Carrier | Image at initial stage (under an environment of medium temperature and medium humidity) | Initial stage Charge amount (μC/g) | Initial stage Fogging on the background | After carriage of 3,000 sheets of paper Charge amount (μC/g) | After carriage of 3,000 sheets of paper Fogging on the background | After carriage of 10,000 sheets of paper Charge amount (μC/g) | After carriage of 10,000 sheets of paper Fogging on the background |
|---|---|---|---|---|---|---|---|---|---|
| Example 3 | A | C | No edge effect, good | −20.2 | ○ | −19.4 | ○ | −18.2 | ○ |
| Example 4 | A | D | No edge eftect, good | −24.5 | ○ | −23.2 | ○ | −23.0 | ○ |

Example 5

Production of Toner Particles B

| | |
|---|---|
| Styrene-butylacrylate copolymer (styrene:butylacrylate = 80:20, Mw = 180,000) | 100 parts |
| carbon black (Legal 330, manufactured by Cabot) | 10 parts |
| Low molecular polypropylene (Viscol 660P, manufactured by Sanyo Chemical Industries Ltd.) | 5 parts |
| Charge control agent (Spiron Black TRH (azochrome-complex), manufactured by Hodogaya Chemical Co., Ltd.) | 1 part |

The above components wee molten-kneaded in Banbury mixer and pulverized using a jet mil after cooling. The pulverized product as further classified using a classifier to prepare toner particles B having an average particle diameter of 9 μm.

Preparation of Toner 100 parts of the toner particles B, 1 part of the above hydrophobic titanium compound microparticles A (present invention), and 1.2 parts of $SiO_2$ (RX 50, manufactured by Japan Aerosil Co., Ltd; BET specific surface area of 50 $m^2/g$) as hydrophobic silica microparticles were mixed using a Henschel mixer to prepare a toner.

Preparation of an Electrostatic Image Developer 5 parts of the prepared toner and 95 parts of the carrier B were mixed to prepare an electrostatic image developer.

Example 6

A toner was prepared in the same manner as in Example 5 except that 0.7 parts of the hydrophobic titanium compound microparticles C (present invention) were used instead of the hydrophobic titanium compound microparticles A (present invention) and the amount of the hydrophobic silica microparticles was changed to 0.8 parts. The toner was mixed with the same carrier as in Example 5 to prepare an electrostatic image developer.

Example 7

A toner was prepared in the same manner as in Example 5 except that 1.1 parts of the hydrophobic titanium compound microparticles E (present invention) were used instead of the hydrophobic titanium compound microparticles A (present invention) and the amount of the hydrophobic silica microparticles was changed to 1.2 parts. The toner was mixed with the same carrier as in Example 5 to prepare an electrostatic image developer.

Example 8

A toner was prepared in the same manner as in Example 5 except that the hydrophobic titanium compound microparticles I (present invention) were used instead of the hydrophobic titanium compound microparticles A (present invention). The toner was mixed with the same carrier as in Example 5 to prepare an electrostatic image developer.

Comparative Example 1

A toner was prepared in the same manner as in Example 5 except that the hydrophobic titanium compound microparticles G (comparative example) were used instead of the hydrophobic titanium compound microparticles A (present invention). The toner was mixed with the same carrier as in Example 5 to prepare an electrostatic image developer.

Comparative Example 2

A toner was prepared in the same manner as in Example 5 except that $SiO_2$ having a BET specific surface area of 200 $m^2/g$ (RX200, manufactured by Japan Aerosil Co., Ltd., average primary particle diameter of about 12 nm) was used instead of this hydrophobic silica microparticles. The toner was mixed with the same carrier as in Example 5 to prepare an electrostatic image developer.

The electrostatic image developers prepared in Examples 5 to 8 and the Comparative Examples 1 and 2 were subjected to continuous copying tests using an electrophotographic copying machine (FX5039, manufactured by Fuji Xerox Co., Ltd.). The results are shown in Table 2. The continuous copying tests were carried out in an environment of medium temperature and medium humidity (22° C., 55%RH) to measure the charge amount, preservation capability of toner, and image defect for a copy sheet at initial stage and after carriage of 100,000 sheets of paper.

Table 2 shows that the electrostatic image developers prepared in Examples 5 to 8 can provide an image having excellent stability with time of charge, environmental dependency, and caking resistance even in repeat use, as compared with the electrostatic image developers prepared in Comparative Examples 1 and 2.

TABLE 2

| | Titanium compound | | | | Silica microparticles | | Charge amount (μC/g) at the initial stage | | Charge amount (μC/g) after carriage of 100,000 sheets of paper | |
|---|---|---|---|---|---|---|---|---|---|---|
| | Sample | BET specific surface area ($m^2/g$) | Specific gravity | Amount (wt %) | BET specific surface area ($m^2/g$) | Amount (wt %) | High temperature and high humidity | Low temperature and low humidity | High temperature and high humidity | Low temperature and low humidity |
| Example 5 | A | 120 | 3.4 | 1.0 | 50 | 1.2 | −22 | −27 | −19 | −24 |
| Example 6 | C | 180 | 3.2 | 0.7 | 50 | 0.8 | −19 | −24 | −17 | −21 |
| Example 7 | B | 40 | 3.1 | 1.1 | 50 | 1.2 | −21 | −25 | −17 | −20 |
| Example 8 | I | 100 | 3.8 | 1.0 | 50 | 1.2 | −17 | −20 | −12 | −16 |
| Comparative example 1 | G | 20 | 3.6 | 1.0 | 50 | 1.2 | −20 | −24 | −14 | −17 |
| Comparative example 2 | A | 120 | 3.4 | 1.0 | 200 | 1.2 | −27 | −45 | −17 | −27 |

| | Overall evaluation of charging | | | | |
|---|---|---|---|---|---|
| | Differences in relation to environmental changes | Maintenance capabitity | Preservation capability of toner | Image defect | Overall evaluation |
| Example 5 | ○ | ○ | No problem | No problem | ○ |
| Example 6 | ○ | ○ | No problem | No problem | ○ |
| Example 7 | ○ | ○ | No problem | No problem | ○ |
| Example 8 | ○ | Δ | GI | F | ○ |
| Comparative example 1 | ○ | Δ | GI | D | Δ |
| Comparative example 2 | Δ | Δ | GI | E | Δ |

Example 9

Production of Toner Particles C

| | |
|---|---|
| Polyester resin (polyester prepared from terephthalic acid/bisphenol A-ethylene oxide adduct/bisphenol A-ethylene oxide adduct/tertiary alcohol, Tg: 66 ° C., Mn: 3,800, Mw: 19,000, acid value: 11, hydroxyl value: 27) | 100 parts |
| Magenta pigment (C.I. Pigment Red 57) | 5 parts |

The above components were kneaded using an extruder and pulverized using a jet mil after cooling. The pulverized product was classified using a pneumatic classifier to prepare toner particles C having an average particle diameter of 6.5 μm.

100 parts of the toner particles C, 0.6 parts of the above hydrophobic titanium compound microparticles B (present invention), and 0.8 parts of hydrophobic silica microparticles (BET specific surface area of 50 $m^2/g$) were mixed using a Henschel mixer to prepare a toner.

6 parts of the prepared toner and 95 parts of the above carrier D were mixed to prepare an electrostatic image developer.

Example 10

A toner was prepared in the same manner as in Example 9 except that the hydrophobic titanium compound microparticles F (present invention) were used instead of the hydrophobic titanium compound microparticles B (present invention). The toner was mixed with the same carrier as in Example 9 to prepare an electrostatic image developer.

Example 11

A toner was prepared in the same manner as in Example 9 except that the hydrophobic titanium compound microparticles H (present invention) were used instead of the hydrophobic titanium compound microparticles B (present invention). The toner was mixed with the same carrier as in Example 9 to prepare an electrostatic image developer.

Example 12

A toner was prepared in the same manner as in Example 9 except that 0.3 parts of the hydrophobic titanium compound microparticles D (present invention) were used instead of the hydrophobic titanium compound microparticles B (present invention). The toner was mixed with the same carrier as in Example 9 to prepare an electrostatic image developer.

Example 13

A toner was prepared in the same manner as in Example 9 except that the amount of the hydrophobic titanium compound microparticles B (present invention) was changed to 2 parts from 0.6 parts. The toner was mixed with the same carrier as in Example 9 to prepare an electrostatic image developer.

Comparative Example 3

A toner was prepared in the same manner as in Example 9 except that the hydrophobic titanium compound microparticles B (present invention) were not used. The toner was mixed with the same carrier as in Example 9 to prepare an electrostatic image developer.

Comparative Example 4

A toner was prepared in the same manner as in Example 9 except that the hydrophobic titanium compound microparticles J (comparative example) were used instead of the hydrophobic titanium compound microparticles B (present invention). The toner was mixed with the same carrier as in Example 9 to prepare an electrostatic image developer.

Comparative Example 5

A toner was prepared in the same manner as in Example 9 except that the hydrophobic silica microparticles were not used. The toner was mixed with the same carrier as in Example 9 to prepare an electrostatic image developer.

The electrostatic image developers prepared in Examples 9 to 13 and the Comparative Examples 3 to 5 were subjected to continuous copying tests using an electrophotographic apparatus (A-color 635, manufactured by Fuji Xerox Co., Ltd.). The results are shown in Table 3.

Table 3 shows that, the electrostatic image developers prepared in Examples 9 to 13 ensure excellent stability with time of charge, environmental dependency, and caking resistance even in repeat use, as compared with the electrostatic image developers prepared in Comparative Examples 3 to 5. Also, use of electrostatic image developers prepared in Examples 9 to 13 ensures improvement in damages and sticking to a photosensitive material whereby an excellent image can be provided for a long period of time.

The charge amount ($\mu$C/g) was measured using a blow-off measuring device. The overall evaluation of charging was executed by carrying out copying tests in the conditions of high temperature and high humidity (30° C., 90% RH) and low temperature and low humidity (10° C., 15% RH) to calculate the differences in relation to changes in conditions and the maintenance capability according to the following formulae:

Differences due to environmental changes={Charge amount at initial stage (High temperature and high humidity/Low temperature and low humidity)+Charge amount after 100,000 copies (High temperature and high humidity/Low temperature and low humidity)}×(½)

Maintenance capability={Charge amount in the condition of high temperature and high humidity (After 100,000 copies/Initial stage)+Charge amount in the condition of low temperature and low humidity (After 100,000 copies/Initial stage)}×(½)

Evaluation criterion for the difference due to environmental changes was as follows: Results including and above "Δ" are an practically acceptable level.

TABLE 3

| | Titanium compound | | | | Silica microparticles | | Charge amount ($\mu$C/g) at the initial stage | | Charge amount ($\mu$C/g) after carriage of 100,000 sheets of paper | |
|---|---|---|---|---|---|---|---|---|---|---|
| | Sample | BET specific surface area ($m^2$/g) | Specific gravity | Amount (wt %) | BET specific surface area ($m^2$/g) | Amount (wt %) | High temperature and high humidity | Low temperature and low humidity | High temperature and high humidity | Low temperature and low humidity |
| Example 9 | B | 100 | 3.5 | 0.6 | 50 | 0.8 | −24 | −27 | −21 | −23 |
| Exampie 10 | F | 90 | 2.8 | 0.6 | 50 | 0.8 | −17 | −20 | −13 | −16 |
| Example 11 | H | 110 | 4.2 | 0.6 | 50 | 0.8 | −18 | −21 | −12 | −16 |
| Example 12 | D | 250 | 3.3 | 0.3 | 50 | 0.8 | −22 | −25 | −18 | −21 |
| Example 13 | B | 100 | 3.5 | 2.0 | 50 | 0.8 | −15 | −19 | −9 | −12 |
| Comparative example 3 | — | — | — | — | 50 | 1.8 | −22 | −36 | −14 | −22 |
| Comparative example 4 | J | 280 | 3.5 | 0.6 | 50 | 0.8 | −26 | −31 | −16 | −21 |
| Comparative example 5 | B | 100 | 3.5 | 0.6 | — | — | −17 | −19 | −10 | −13 |

| | Overall evaluation of charging | | | | |
|---|---|---|---|---|---|
| | Differences in relation to environmental changes | Maintenance capabitity | Preservation capability of toner | Image defect | Overall evaluation |
| Example 9 | ○ | ○ | No problem | No problem | ○ |
| Example 10 | ○ | ○ | No problem | No problem | ○ |
| Example 11 | ○ | Δ | No problem | F | ○ |
| Example 12 | ○ | ○ | No problem | No problem | ○ |
| Example 13 | Δ | Δ | No problem | F | ○ |
| Comparative example 3 | Δ | Δ | No problem | E | Δ |
| Comparative example 4 | Δ | Δ | GI | P | Δ |
| Comparative example 5 | ○ | Δ | GI | F | Δ |

<Evaluation>

The criteria for each evaluation item in Tables 1 to 3 are as follows:

(1) Condition of fogging on the background

The condition of fogging on the background was visually evaluated according to the following criterion:

○: No fogging was observed

Δ: Fogging was slightly observed but an practically acceptable x: Fogging was considerably observed (2) Charge amount and overall evaluation of charging ○: Differences ≧0.8

Δ: Differences ≧0.6 x: Differences <0.6

Evaluation criterion for the maintenance capability was as follows: Results including and above "Δ" are an practically acceptable level.

○: Maintenance capability ≧0.8

Δ: Maintenance capability ≧0.6 x: Maintenance capability <0.6

(3) Self stability of toner

The self stability of the toner was evaluated according to the following criterion: Levels including and above "G1" are practically acceptable.

No problem: No coagulation of the toner was found even after 100,000 copies;

G1: Slight coagulation of the toner occurred after 100,000 copies, but it was an acceptable level;

G2: Coagulation of the toner occurred after 80,000 copies;

G3: Coagulation of the toner occurred after 60,000 copies and before 80,000 copies;

G4: Coagulation of the toner occurred after 40,000 copies and before 60,000 copies.

(4) Image defect

The copied image quality after carriage of 100,000 sheets of paper was evaluated. Levels ranging from "D" to "F" are practically acceptable in the following criterion:

No problem: Excellent image quality was maintained without image defects including the reducted density, fogging on the background, and white spots after 100,000 copies.

A: Image density decreased with time, which was caused by the increased differences of charging due to environmental changes;

B: Sticking of toner to a photosensitive material and white spots of an image occurred;

C: Image density decreased with time, which was caused by the increased differences of charging due to environmental changes and the decreased maintenance capability of charging;

D: Fogging on the background slightly occurred due to admixing inferior;

E: Fogging on the background slightly occurred with time, which was caused by the increased differences of charging due to environmental changes;

F: Image density tended to decrease with time, especially in the condition of high temperature and high humidity, but there was no problem on the image quality.

What is claimed is that:

1. An electrostatic image developer comprising a toner and a carrier, wherein said toner includes toner particles having an average particle diameter of 3 to 9 $\mu$m; a hydrophobic silica microparticles having a BET specific surface area of 40 to 120 $m^2/g$; and a hydrophobic titanium compound microparticles having a BET specific surface area of 40 to 250 $m^2/g$, and wherein said carrier is a resin coated carrier having a coating layer of a resin.

2. An electrostatic image developer according to claim 1, wherein a weight ratio (b/a) of the amount of said hydrophobic titanium compound microparticles (b % by weight) to the amount of said hydrophobic silica microparticles (a % by weight) is less than 1, that is (b/a)<1.

3. An electrostatic image developer according to claim 1, wherein the amount of said hydrophobic silica microparticles is less than 2% by weight based on the amount of said toner and the amount of said hydrophobic titanium compound microparticles is less than 1.5% by weight based on the amount of said toner.

4. An electrostatic image developer according to claim 1, wherein said hydrophobic titanium compound microparticles are prepared by reacting $TiO(OH)_2$ with a silane compound.

5. An electrostatic image developer according to claim 1, wherein the specific gravity of said hydrophobic titanium compound microparticles is from 2.8 to 3.6.

6. An electrostatic image developer according to claim 1, wherein said toner particles contain a linear polyester as a binding resin.

7. An electrostatic image developer according to claim 1, wherein said resin contains at least a fluorine-type resin and/or a silicone resin.

8. An electrostatic image developer according to claim 1, wherein said coating is comprised of said resin and resin particles dispersed in said resin.

9. An electrostatic image developer according to claim 8, wherein the particle diameter of said resin particles is from 0.1 to 2 $\mu$m.

10. An electrostatic image developer according to claim 8, wherein said resin particles are resin particles made of a nitrogen-containing resin.

11. An electrostatic image developer according to claim 8, wherein said resin particles are resin particles made of a cross-linking resin.

12. An electrostatic image developer according to claim 1, wherein said coating comprises electroconductive particles dispersed in said resin.

13. An electrostatic image developer according to claim 12, wherein said electroconductive particles are comprised of carbon black.

14. An image forming method comprising a step of developing an electrostatic latent image formed on an electrostatic latent image support member using a developer layer on a developer holding member carrying the developer, wherein said developer comprises a toner and a carrier;

wherein said toner includes toner particles having an average particle diameter of 3 to 9 $\mu$m, a hydrophobic silica microparticles having a BET specific surface area of 40 to 120 $m^2/g$, and a hydrophobic titanium compound microparticles having a BET specific surface area of 40 to 250 $m^2/g$; and wherein said carrier is a resin coated carrier having a coating layer of a resin.

15. An image forming device comprising a means of developing an electrostatic latent image formed on an electrostatic latent image support member using a developer layer on a developer holding member carrying the developer, wherein said developer comprises a toner and a carrier;

wherein said toner includes toner particles having an average particle diameter of 3 to 9 $\mu$m, a hydrophobic silica microparticles having a BET specific surface area of 40 to 120 $m^2/g$, and a hydrophobic titanium compound microparticles having a BET specific surface area of 40 to 250 $m^2/g$; and wherein said carrier is a resin coated carrier having a coating layer of a resin.

16. An electrostatic image developer according to claim 1, wherein the hydrophobic silica microparticles have a BET specific surface area of 40 to 80 $m^2/g$, and the hydrophobic titanium compound microparticles have a BET specific surface area of 70 to 180 $m^2/g$.

17. An image forming method according to claim 14, wherein the hydrophobic silica microparticles have a BET specific surface area of 40 to 80 $m^2/g$, and the hydrophobic titanium compound microparticles have a BET specific surface area of 70 to 180 $m^2/g$.

18. An image forming device according to claim 15, wherein the hydrophobic silica microparticles have a BET specific surface area of 40 to 80 $m^2/g$, and the hydrophobic titanium compound microparticles have a BET specific surface area of 70 to 180 $m^2/g$.

* * * * *